United States Patent [19]

Schumann et al.

[11] Patent Number: 4,520,831

[45] Date of Patent: Jun. 4, 1985

[54] PLASTIC HAIRDRESSING COMB

[75] Inventors: Henning Schumann, Hilden; Peter Busch, Erkrath; Detlef Fischer, Duesseldorf; Klaus Thiele, Langenfeld, all of Fed. Rep. of Germany

[73] Assignee: Henkel Kommanditgesellschaft auf Aktien, Duesseldorf, Fed. Rep. of Germany

[21] Appl. No.: 590,104

[22] Filed: Mar. 16, 1984

[30] Foreign Application Priority Data

Mar. 19, 1983 [DE] Fed. Rep. of Germany ..... 3309925

[51] Int. Cl.[3] ..... A45D 24/00

[52] U.S. Cl. ..... 132/11 R

[58] Field of Search ..... 132/11 R, 85 R, 120, 132/1 R, 163, 110–112; 527/312; 260/17 R, 17.4 GC

[56] References Cited

U.S. PATENT DOCUMENTS

| | | | |
|---|---|---|---|
| 3,072,944 | 1/1963 | Clayton et al. | 15/159 A |
| 4,013,086 | 3/1977 | Chmela | 132/11 R |
| 4,290,438 | 9/1981 | Price | 132/11 R |
| 4,421,129 | 12/1983 | Wingard | 132/11 R |

*Primary Examiner*—Gregory E. McNeill

*Attorney, Agent, or Firm*—Ernest G. Szoke; Nelson Littell, Jr.

[57] ABSTRACT

In order to neutralize the electrostatic charging of the hair which occurs where a plastic comb is used, the comb is made up of at least one section which negatively charges the hair during combing and at least one section which positively charges the hair during combing.

9 Claims, 3 Drawing Figures

PLASTIC HAIRDRESSING COMB

BACKGROUND OF THE INVENTION

This invention relates to a plastic hairdressing comb with teeth and a spine, where the comb contains at least one section which negatively charges the hair during combing and at least one section which positively charges the hair during combing.

When hair is combed with a plastic hairdressing comb, the hair and the comb generally become electrostatically charged in a totally uncontrolled manner, particularly in a dry atmosphere. This makes the hair difficult to comb.

The electrostatic charging of hair during combing is caused by frictional electricity (triboelectric effect). On account of the insulating properties of the comb and the hair, the separate charges are unable to dissipate and lead to charge accumulations of opposite polarity on the hair and the comb. It is possible in this connection to set up a potential series whereby positive charging occurs in the event of rubbing with a substance which follows in the potential series, while negative charging occurs in the event of rubbing with the preceding substance in the potential series. Coehn's law of charging states for insulators that the substance with the higher dielectric constant is positively charged.

Even if one of the substances coming into contact is a conductor, charging of the other substance cannot be completely prevented because at least some of the charged produced on the insulator in the event of rubbing on the conductor remain there. Accordingly, even if a metal comb or a metal-coated plastic comb is used, it is not possible to avoid individually more or less heavy and troublesome electrostatic charging, particularly in a dry atmosphere (and dry hair).

OBJECTS OF THE INVENTION

An object of the present invention is the development of a plastic hairdressing comb which, on combing the hair, electrostatically charges the hair in a certain way, more particularly not to any significant extent and not in a troublesome manner.

Another object of the present invention is the development of a plastic hairdressing comb comprising teeth and a spine consisting essentially of at least one section which negatively charges the hair during combing and at least one section which positively charges the hair during combing.

These and other objects of the invention will become more apparent as the description of the invention is set forth.

THE DRAWINGS

DESCRIPTION OF THE INVENTION

The present invention seeks to solve the problem of providing a plastic comb, during whose use the hair is electrostatically charged in a certain way, more particularly not to any significant extent and not in a troublesome manner. In the hairdressing comb mentioned at the beginning, the solution provided by the invention is characterized by a comb structure of at least one section which negatively charges the hair during combing and at least one section which positively charges the hair during combing.

More particularly, the present invention relates to a plastic hairdressing comb comprising teeth and a spine consisting essentially of at least one section which negatively charges the hair during combing and at least one section which positively charges the hair during combing.

According to the invention, therefore, the comb is made up of materials, one of which comes before the hair in the potential series mentioned above while the other comes after the hair in that potential series. In terms of Coehn's law of charging, the invention may also be described by stating that the comb is to be composed of at least two insulating individual regions, the material of one of the individual regions being intended to have a lower dielectric constant than the hair and the material of the other region a higher dielectric constant than the hair.

Through the use in accordance with the invention of two plastics which, on their own, charge the hair during combing to substantially the same extent, but with different polarity, it is possible automatically to neutralize the electrostatic charging of the hair which normally occurs during combing. The ratio between the volumes and/or the spatial distribution of the two sections are preferably selected to neutralize the charges produced on the hair by the sections in a reciprocal manner. Providing material, volume and spatial distribution are appropriately adapted, hair combed with the comb according to the invention shows virtually no resulting electrostatic charge. Basically, however, it is also possible in accordance with the invention to impose a certain, intentional electrostatic charge by correspondingly selecting the individual materials, the volume ratios and/or the spatial distributions of the two sections.

Figure 1:
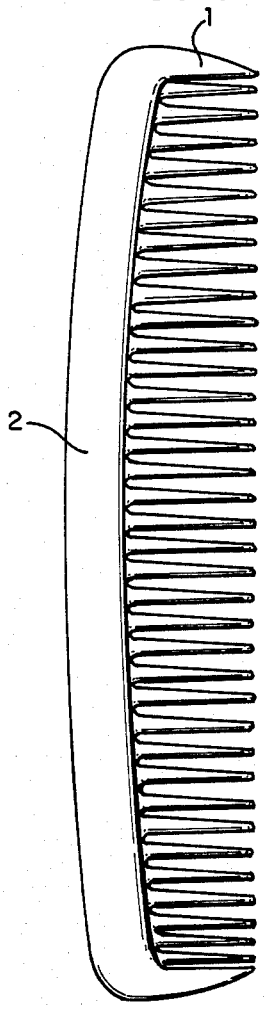
FIG. 1 is a plan view of the comb of the invention.

One example of embodiment of the invention showing further details thereof is described in the following with reference to the accompanying diagrammatic drawings, wherein:

FIG. 1 is an overall view of the comb.

Figure 2:
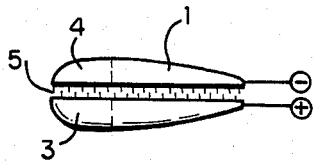
FIG. 2 is a cross-section taken longitudinally of the comb of FIG. 1.

FIG. 2 is a cross-section taken longitudinally of the comb.

Figure 3:
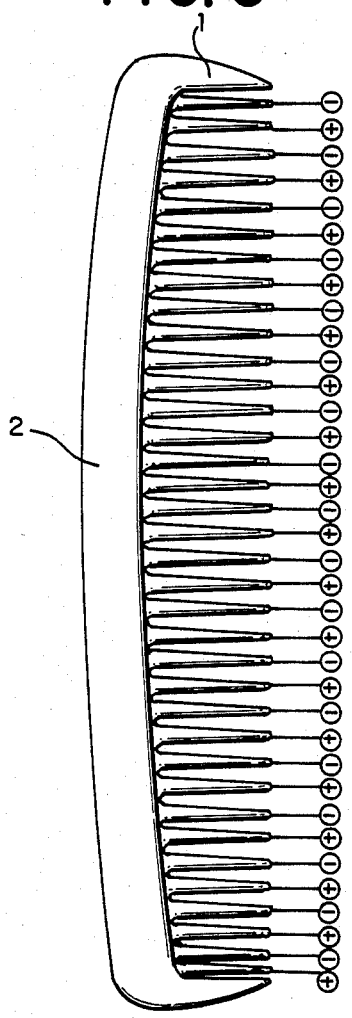
FIG. 3 is a plan view of another embodiment of the invention.

FIG. 3 is an overall view of the comb with teeth of alternate material.

The comb shown in FIGS. 1 and 2 consists of teeth 1 and a spine 2. For example, the comb shown in FIG. 2 may be given a laminar structure in the form of two layers 3 and 4 covering all the teeth 1 and the spine 2. The two layers may be joined together by means of an adhesive layer 5 to form a complete instrument.

Although the example of embodiment of the volume distribution of the individual materials of the comb shown in FIG. 2 is particularly favorable, it does not represent the only possible construction. To achieve the required result, it is even possible for example to make complete teeth alternately of one type of material or the other as shown in FIG. 3.

The materials of the two sections for producing the comb are selected from the above-mentioned potential series in such a way that in use, the comb produces a certain, but generally not resulting in a troublesome manner, charging of the hair. In one particularly favorable embodiment, one section consists of polyamide, particularly nylon, and the other section of polyethylene or an acrylonitrile-butadiene-styrene copolymer.

One particularly suitable polymer which may be combined with nylon in accordance with the invention is the material Lupolen ®, a product of BASF AG, Ludwigshafen.

Other plastic materials of construction of the comb can be readily determined from the potential series discussed above. "Lupolen ®" is a polymer of the polyethylene type. It can be a hompolymer or an ethylene copolymer. The CH-claims can be straight or branched.

The preceding specific embodiments are illustrative of the practice of the invention. It is to be understood however, that other expedients known to those skilled in the art or disclosed herein may be employed without departing from the spirit of the invention or the scope of the appended claims.

We claim:

1. A plastic hairdressing comb comprising teeth and a spine consisting essentially of at least one section which negatively charges the hair during combing and at least one section which positively charges the hair during combing, wherein the volume ratio and/or the spatial distribution of the at least one section which negatively charges the hair during combing and the at least one section which positively charges the hair during combing are selected to neutralize the charge produced on the hair by the individual sections in a reciprocal manner.

2. The plastic hairdressing comb of claim 1 wherein two adhesively joined layers are employed as said individual sections, each incorporating all the teeth.

3. The plastic hairdressing comb of claim 1 wherein adjacent teeth consist alternately of the material of one section which negatively charges the hair during combing and the material of one section which positively charges the hair during combing.

4. The plastic hairdressing comb of claim 1 wherein one section consists of a polyamide and the other section consists of a plastic selected from the group consisting of polyethylene and an acrylonitrile-butadiene-styrene copolymer.

5. The plastic hairdressing comb of claim 7 wherein said polyamide is nylon.

6. The plastic hairdressing comb of claim 2 wherein one section consists of a polyamide and the other section consists of a plastic selected from the group consisting of polyethylene and an acrylonitrile-butadiene-styrene copolymer.

7. The plastic hairdressing comb of claim 6 wherein said polyamide is nylon.

8. The plastic hairdressing comb of claim 3 wherein one section consists of a polyamide and the other section consists of a plastic selected from the group consisting of polyethylene and an acrylonitrile-butadiene-styrene copolymer.

9. The plastic hairdressing comb of claim 8 wherein said polyamide is nylon.

* * * * *